US009008350B2

(12) United States Patent
Ajiki et al.

(10) Patent No.: US 9,008,350 B2
(45) Date of Patent: Apr. 14, 2015

(54) LOUDSPEAKER, ELECTRONIC DEVICE AND MOBILE DEVICE BOTH INCLUDING THE SAME, AND METHOD OF PRODUCING THE SAME

(71) Applicant: Panasonic Corporation, Osaka (JP)

(72) Inventors: Kenichi Ajiki, Mie (JP); Toshinori Yamaji, Mie (JP); Keiji Ishikawa, Mie (JP); Masamichi Ara, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/240,027

(22) PCT Filed: Jun. 18, 2013

(86) PCT No.: PCT/JP2013/003777

§ 371 (c)(1),
(2) Date: Feb. 21, 2014

(87) PCT Pub. No.: WO2013/190824

PCT Pub. Date: Dec. 27, 2013

(65) Prior Publication Data

US 2014/0193026 A1 Jul. 10, 2014

(30) Foreign Application Priority Data

Jun. 22, 2012 (JP) ..... 2012-140497
Jul. 11, 2012 (JP) ..... 2012-155307

(51) Int. Cl.

*H04R 1/00* (2006.01)
*H04R 31/00* (2006.01)
*H04R 9/02* (2006.01)

(52) U.S. Cl.

CPC .. *H04R 1/00* (2013.01); *H04R 9/02* (2013.01); *H04R 31/006* (2013.01); *H04R 2499/13* (2013.01)

(58) Field of Classification Search

CPC ..... H04R 9/02; H04R 9/025; H04R 9/06; H04R 2201/34; H04R 2400/11; H04R 1/00; H04R 31/006; H04R 2499/13

USPC ..... 381/388, 389, 433

See application file for complete search history.

(56) References Cited

U.S. PATENT DOCUMENTS 1,941,961 A * 1/1934 Booth et al. ..... 381/389
7,079,665 B2 * 7/2006 Shimomura et al. ..... 381/433

(Continued)

FOREIGN PATENT DOCUMENTS

CN 101213868 7/2008
CN 102170604 8/2011

(Continued)

OTHER PUBLICATIONS

English Translation of Chinese Search Report issued on Aug. 29, 2014 for the related Chinese Patent Application No. 201380003045.8.

(Continued)

*Primary Examiner* — Brian Ensey
(74) *Attorney, Agent, or Firm* — Panasonic Patent Center

(57) ABSTRACT

A magnetic circuit includes an upper plate, a magnet, a lower plate, and a center pole. The outer circumference of a frame is coupled with a diaphragm. One end of a voice coil is coupled with the diaphragm, and the other end is inserted into a magnetic gap formed between the upper plate and the center pole. The frame is provided with a through hole. An insertion part provided on the outer circumference of the upper plate is inserted into the through hole. The frame is coupled with the upper plate by bending the insertion part.

17 Claims, 12 Drawing Sheets

(56) References Cited

U.S. PATENT DOCUMENTS

| | | | | |
|---|---|---|---|---|
| 2004/0042631 | A1 | 3/2004 | Amino | |
| 2005/0047625 | A1 | 3/2005 | Matsuda et al. | |
| 2007/0116323 | A1* | 5/2007 | Hikichi | 381/396 |
| 2008/0292128 | A1* | 11/2008 | Ishii | 381/388 |
| 2010/0150389 | A1 | 6/2010 | Sumiyama et al. | |
| 2011/0207588 | A1 | 8/2011 | Min | |

FOREIGN PATENT DOCUMENTS

| | | |
|---|---|---|
| JP | 40-028565 Y | 10/1965 |
| JP | 61-063196 | 4/1986 |
| JP | 03-155299 | 7/1991 |
| JP | 05-292595 | 11/1993 |
| JP | 2004-088589 | 3/2004 |
| JP | 2004-248016 | 9/2004 |
| JP | 2005-080111 | 3/2005 |

OTHER PUBLICATIONS

International Search Report of PCT Application No. PCT/JP2013/003777 dated Sep. 10, 2013.

* cited by examiner

LOUDSPEAKER, ELECTRONIC DEVICE AND MOBILE DEVICE BOTH INCLUDING THE SAME, AND METHOD OF PRODUCING THE SAME

CROSS-REFERENCE TO RELATED APPLICATIONS

The present application is a U.S. national phase application of PCT international application PCT/JP2013/003777 filed on Jun. 18, 2013, which claims priority to Japanese Patent Application No. 2012-140497 filed on Jun. 22, 2012 and Japanese Patent Application No. 2012-155307 filed on Jul. 11, 2012, the contents all of which are incorporated herein by reference.

TECHNICAL FIELD

The technical field relates to a loudspeaker used for car-mounted devices and various types of audio devices, to an electronic device and a mobile device both including the loudspeaker, and to a method of producing the loudspeaker.

BACKGROUND ART

Hereinafter, a description is made of conventional loudspeaker 111 with reference to a drawing. FIG. 13 is a sectional view of loudspeaker 111. Loudspeaker 111 includes magnetic circuit 104 of external-magnet type, frame 106, diaphragm 107, voice coil 108, and damper 109. Loudspeaker 111 may further include sub-cone 110. Alternatively, loudspeaker 111 may include a dust cap instead of sub-cone 110.

Magnetic circuit 104 includes upper plate 101, magnet 102, and lower plate 103. Upper plate 101 and lower plate 103 sandwich magnet 102 therebetween. Magnetic gap 105 is formed between the center pole provided at the central part of lower plate 103, and upper plate 101.

Upper plate 101 is joined with frame 106, which is made of resin. The circumference of frame 106 is bonded to the outer circumference of diaphragm 107 with an adhesive agent.

One end of voice coil 108 is joined with the central part of diaphragm 107. The other end of voice coil 108 is inserted into magnetic gap 105 of magnetic circuit 104. Damper 109 links frame 106 and voice coil 108, and holds voice coil 108 at the center of frame 106. The front surface of coil 108 has sub-cone 110 bonded thereonto.

Upper plate 101 has projection 101A. Projection 101A, fitted into through hole 106A provided in frame 106, makes upper plate 101 joined with frame 106. Upper plate 101 is formed by press work using a mold, for instance, and so is projection 101A.

Next, to join upper plate 101 with frame 106, projection 101A is firstly inserted into through hole 106A. Then, projection 101A is punched and transformed with the mold. In this way, upper plate 101 is joined with frame 106. Alternatively, projection 101A is crushed using a rotating jig, as in high spin method. Upper plate 101 is joined with frame 106 due to transformation of projection 101A.

Examples of information on prior art documents related to this patent application include patent literatures 1 and 2.

CITATION LIST

Patent Literature

PTL 1 Japanese Patent Unexamined Publication No. 2005-080111

PTL 2 Japanese Patent Unexamined Publication No. 2004-088589

SUMMARY OF THE INVENTION

The magnetic circuit of a loudspeaker of the present invention includes a frame, an upper plate, a magnet, a lower plate, and a center pole. The upper plate is coupled with a lower face of the frame. The magnet is provided under the upper plate. The lower plate is provided under the magnet. The center pole is formed at a central part of the lower plate. The center pole and the upper plate have a magnetic gap formed therebetween. The outer circumference of the frame is coupled with a diaphragm. Further, one end of the voice coil is coupled with the diaphragm, the other end is inserted in the magnetic gap. The frame is provided with a through hole. An insertion part provided on a part of the outer circumference of the upper plate is inserted into the through hole. A part of the insertion part that penetrates the frame is bent.

The above-described structure allows the frame to be coupled with the upper plate, provides a required level of coupling strength between the frame and the upper plate, and further allows the upper plate to be thinner.

The method of producing a loudspeaker of the present invention includes inserting an insertion part of an upper plate which forms a magnetic circuit together with a magnet, a lower plate, and a center pole, into a through hole formed in the frame; coupling a main part of the upper plate with a lower face of the frame by bending a penetrating part of the insertion part that has been inserted into the through hole of the frame and has penetrated the frame; inserting a first end of a voice coil into a magnetic gap; and coupling the diaphragm to be coupled with the second end of the voice coil, with the frame.

The above-described producing method provides a required level of coupling strength between the frame and the upper plate, and further allows the upper plate to be thinner.

DESCRIPTION OF EMBODIMENT

Figure 1:
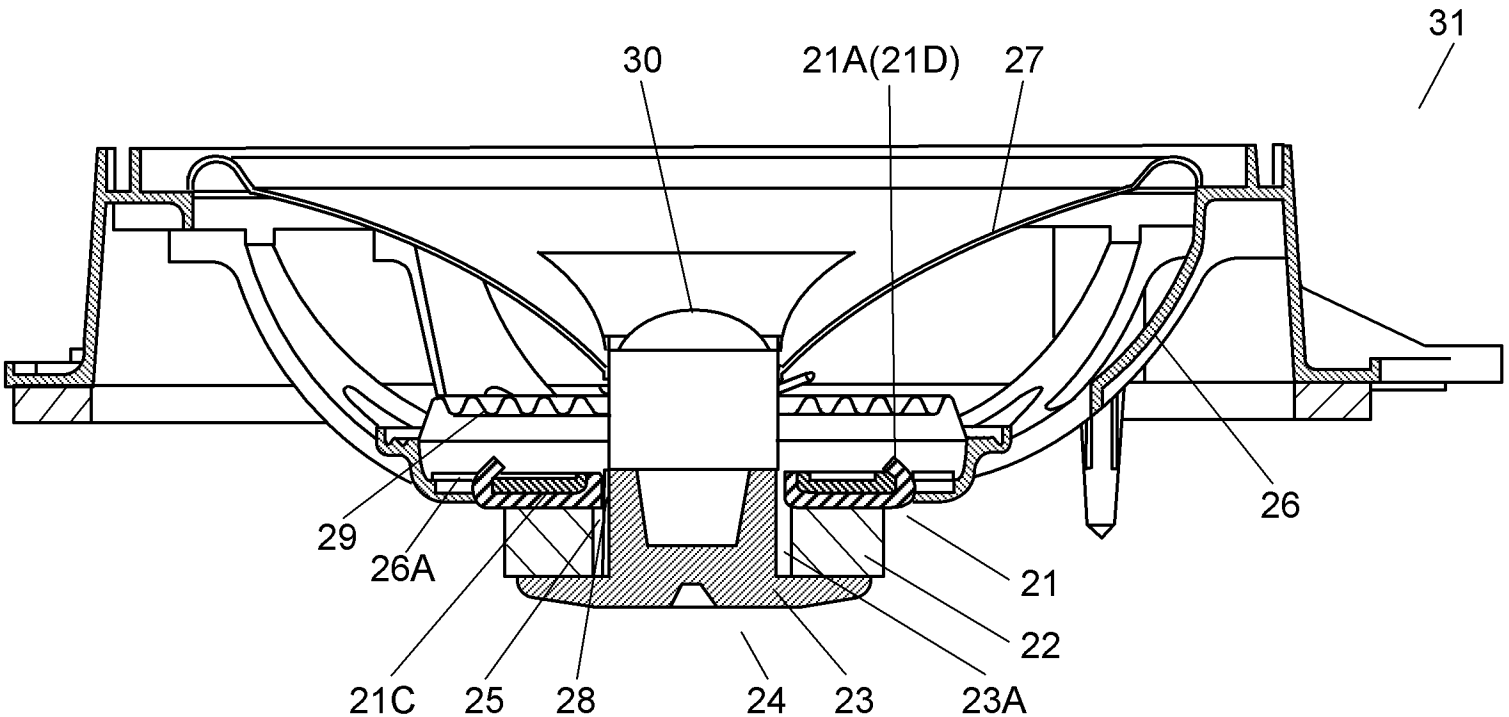
FIG. 1 is a sectional view of a loudspeaker according to an embodiment of the present invention.
Figure 2:
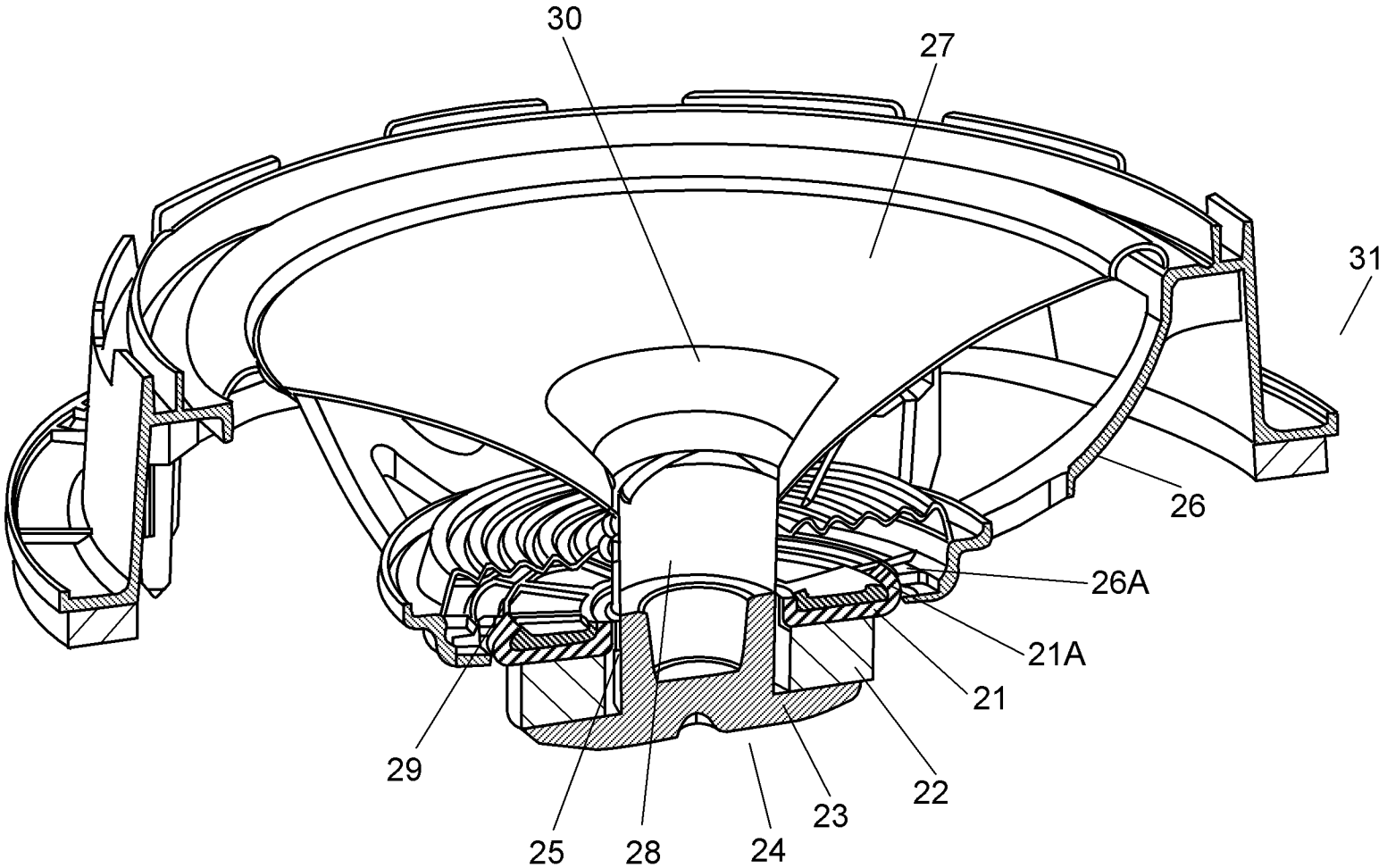
FIG. 2 is a perspective view of the loudspeaker according to the embodiment of the present invention.

Hereinafter, a description is made of an embodiment of the present invention with reference to drawings. FIG. 1 is a sectional view of loudspeaker 31 according to the embodiment of the present invention. FIG. 2 is a perspective view of loudspeaker 31. Loudspeaker 31 includes magnetic circuit 24, frame 26 made of resin and provided with through hole 26A therein, diaphragm 27, and voice coil 28. Magnetic circuit 24 includes upper plate 21, magnet 22, lower plate 23, and center pole 23A. Upper plate 21 includes main part 21C and insertion part 21A.

The central part of frame 26 is provided with a bottom part for joining magnetic circuit 24, where the bottom is preferably flat-shaped. Further, the shape of frame 26 viewed from above is preferably circular. Hence, frame 26 is preferably bowl-shaped or truncated-cone-shaped. Upper plate 21 is joined onto the underside of the bottom of frame 26. Frame 26, made of resin, is extremely light. Besides resin, frame 26 may be made of metal, which increases the strength and thermal resistance of frame 26.

The circumference of frame 26 is bonded with the outer circumference of diaphragm 27. Voice coil 28 has a first end and a second end. The first end is coupled with the central part of diaphragm 27, while the second end is inserted into magnetic gap 25. Damper 29 links frame 26 and voice coil 28, and holds voice coil 28 at the center of frame 26. The front surface of voice coil 28 may have sub-cone 30 bonded thereto. Instead of sub-cone 30, a dust cap may be bonded to the front surface of coil 28.

Upper plate 21 and lower plate 23 sandwich magnet 22 therebetween. Center pole 23A is formed at the central part of lower plate 23 so as to project from lower plate 23. Center pole 23A penetrates through the hole formed in the center of upper plate 21. Due to this structure, magnetic gap 25 is formed between the side surface of center pole 23A and the inner side surface of upper plate 21. Consequently, a magnetic pole is formed at the end of the inner circumference of upper plate 21.

Magnetic circuit 24 is coupled with the bottom provided at the central part of frame 26, such that upper plate 21 is located at the upper side.

Automobiles of recent years are requested to reduce use materials and to improve fuel efficiency by weight reduction from the viewpoint of preserving the global environment. This strongly requests parts of devices (e.g., loudspeaker 31) incorporated in automobiles to reduce their weight and to save resources. Hence, frame 26 of loudspeaker 31 used for vehicles and the like is made of resin in order to reduce the weight and to save the resource. For further weight reduction and resource saving of loudspeaker 31, parts other than frame 26 are required so.

Figure 13:
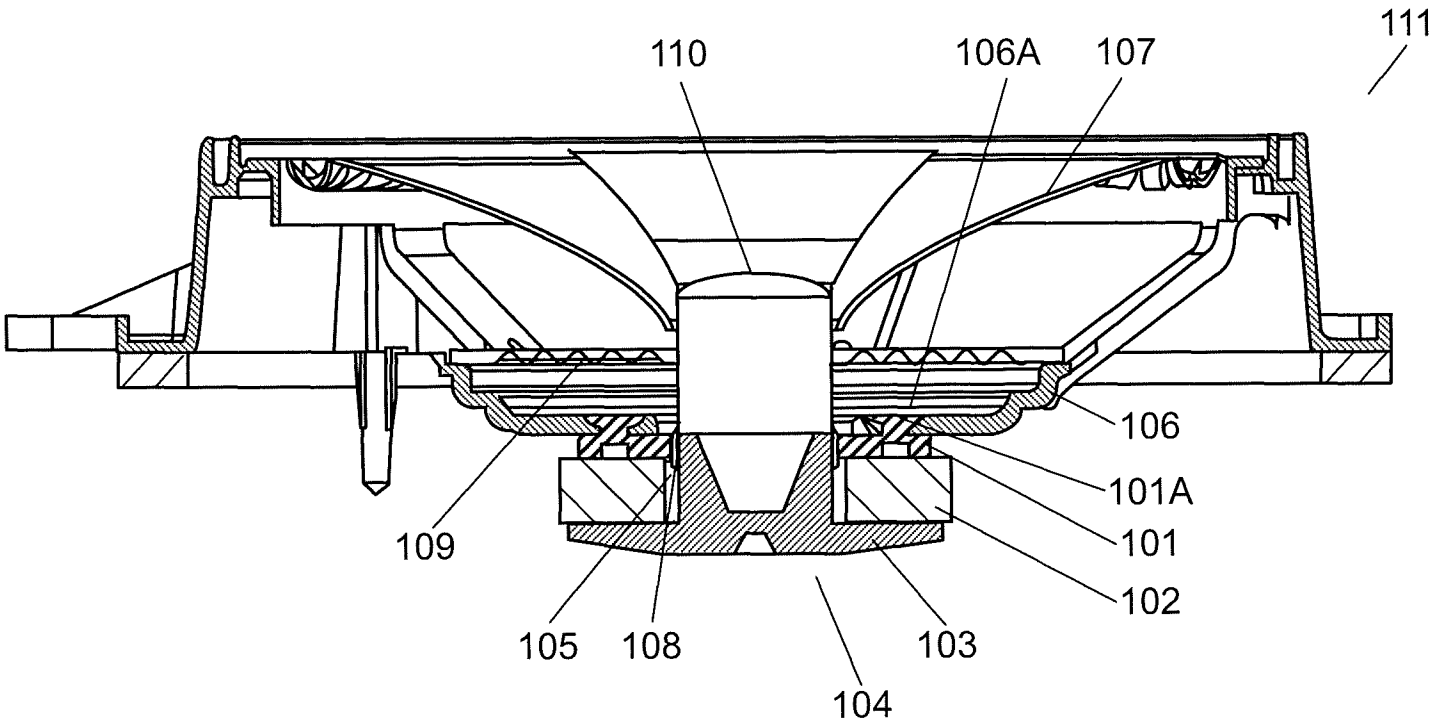
FIG. 13 PRIOR ART
FIG. 13 is a sectional view of a conventional loudspeaker.

In loudspeaker 111 of FIG. 13, however, frame 106 needs to be thick enough to achieve a required level of strength. Further, projection 101A of loudspeaker 111, formed by press work, needs to be high enough to increase the coupling strength between frame 106 and upper plate 101. To make projection 101A high, upper plate 101 needs to be thick. Consequently, it is difficult for upper plate 101 to be thin to achieve weight reduction and resource saving, which means it difficult to reduce the weight of loudspeaker 111.

The present invention solves the above problems. Specifically, the coupling strength between frame 26 and upper plate 21 can be increased, and the weight of loudspeaker 31 and materials used for loudspeaker 31 can be reduced.

Figure 3:
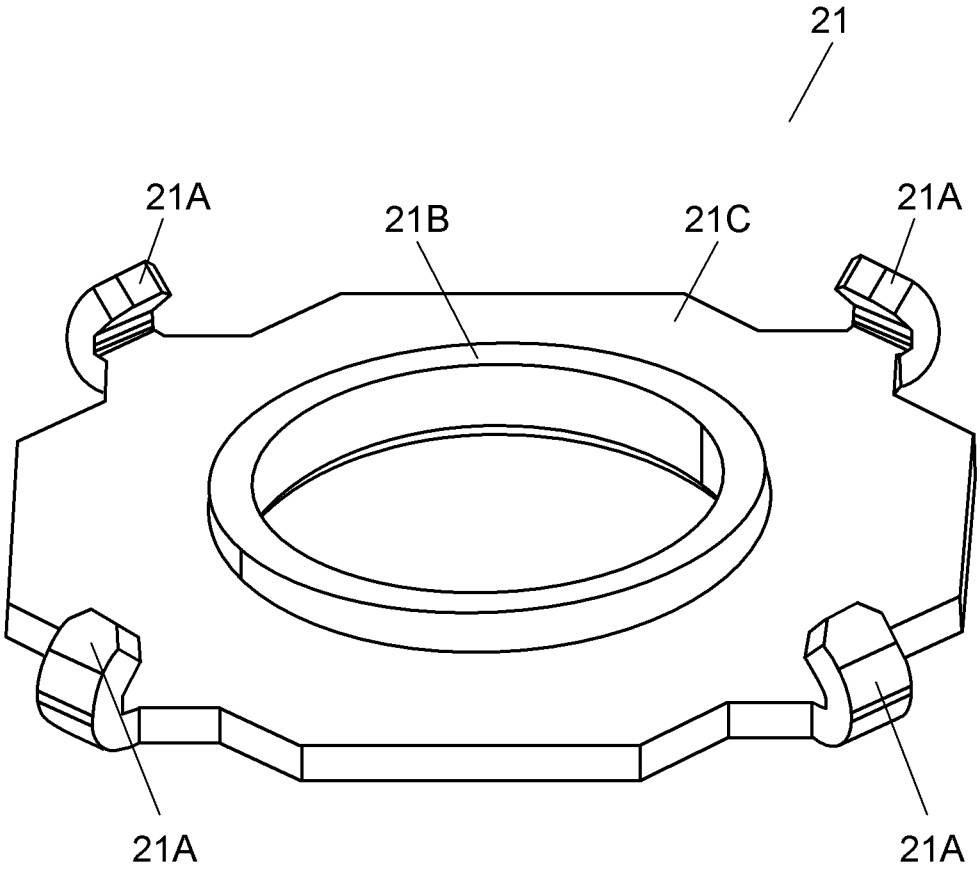
FIG. 3 is a perspective view of the upper plate of the loudspeaker according to the embodiment of the present invention.
Figure 4:
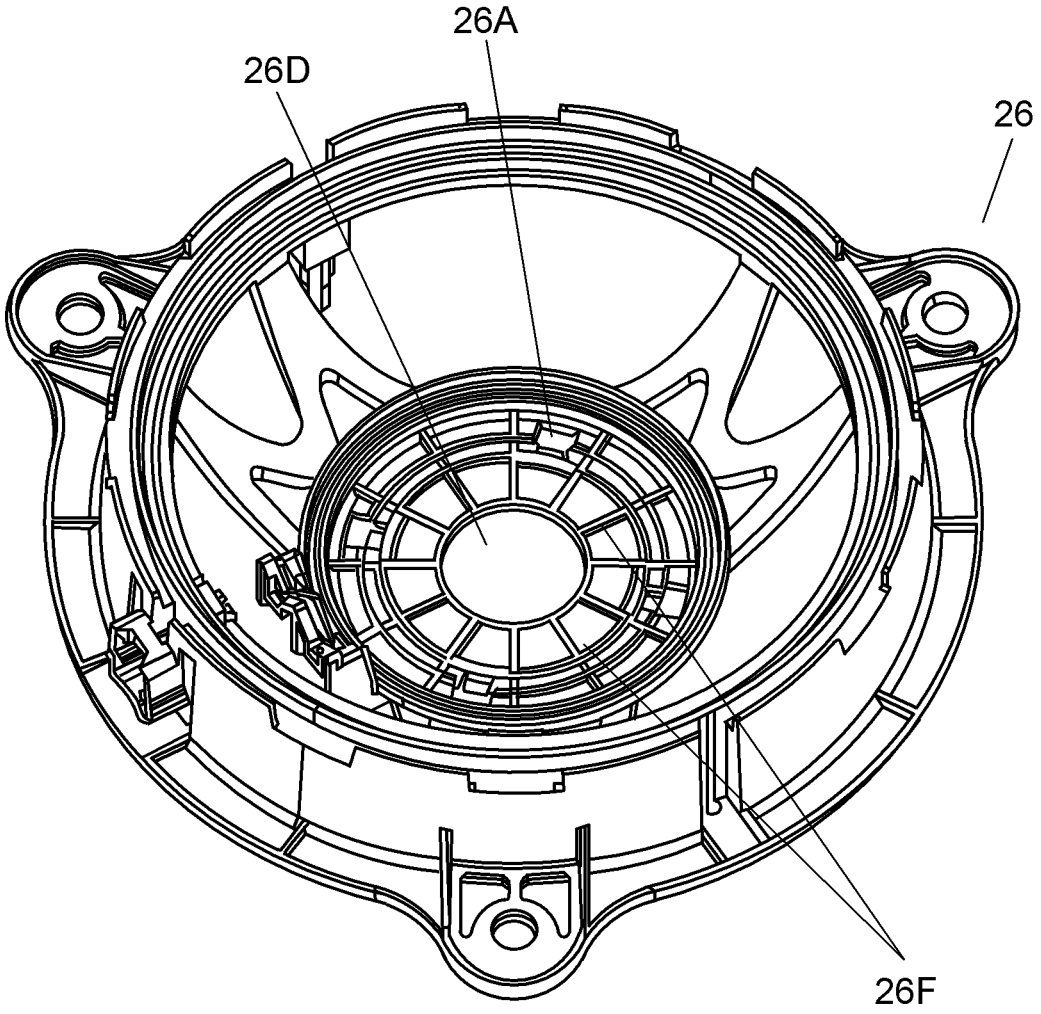
FIG. 4 is a perspective view of the frame of the loudspeaker according to the embodiment of the present invention.
Figure 5:
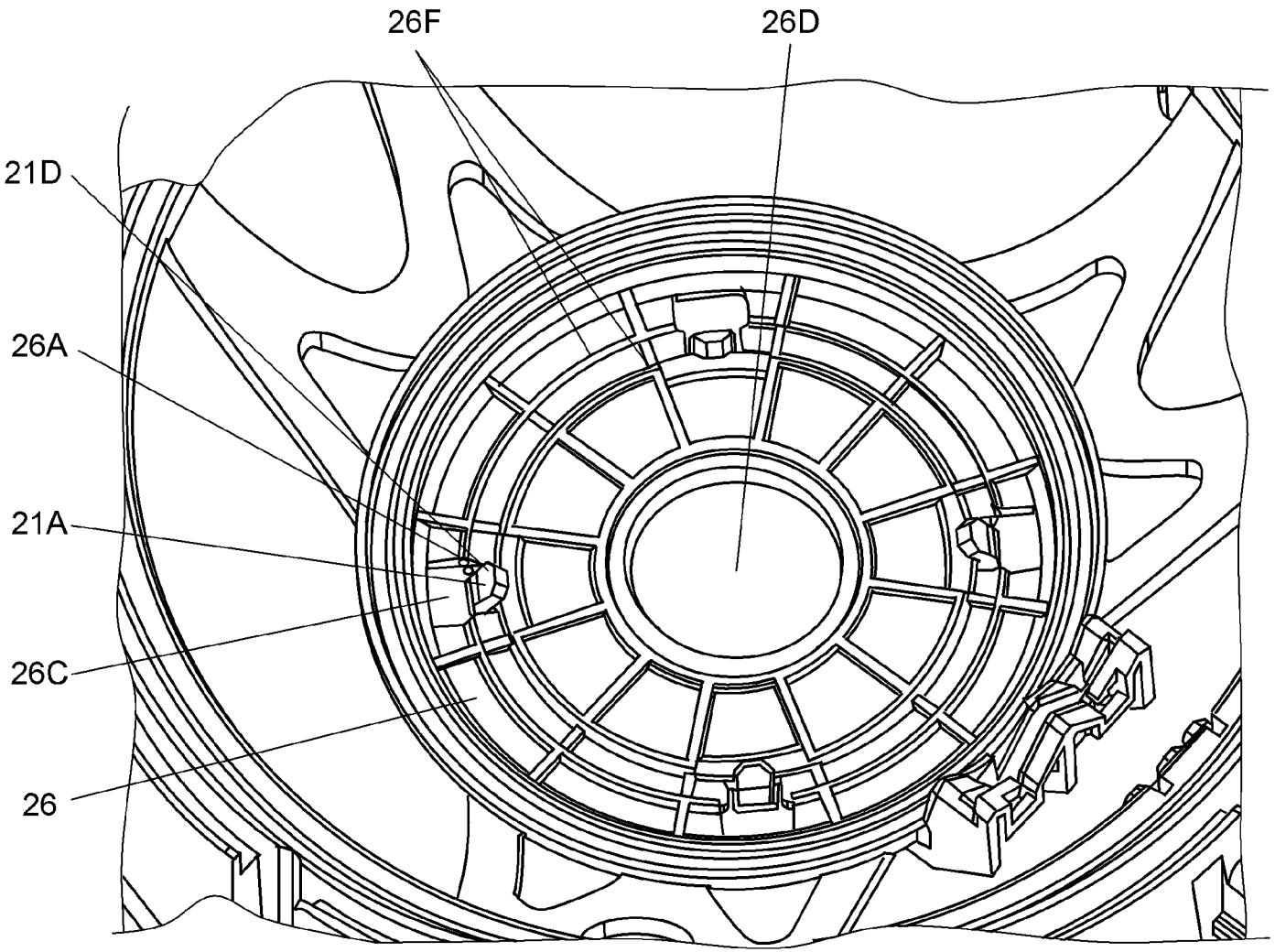
FIG. 5 is an enlarged perspective view of the substantial part of the loudspeaker according to the embodiment of the present invention, in a state where the frame is coupled with the upper plate.
Figure 6:
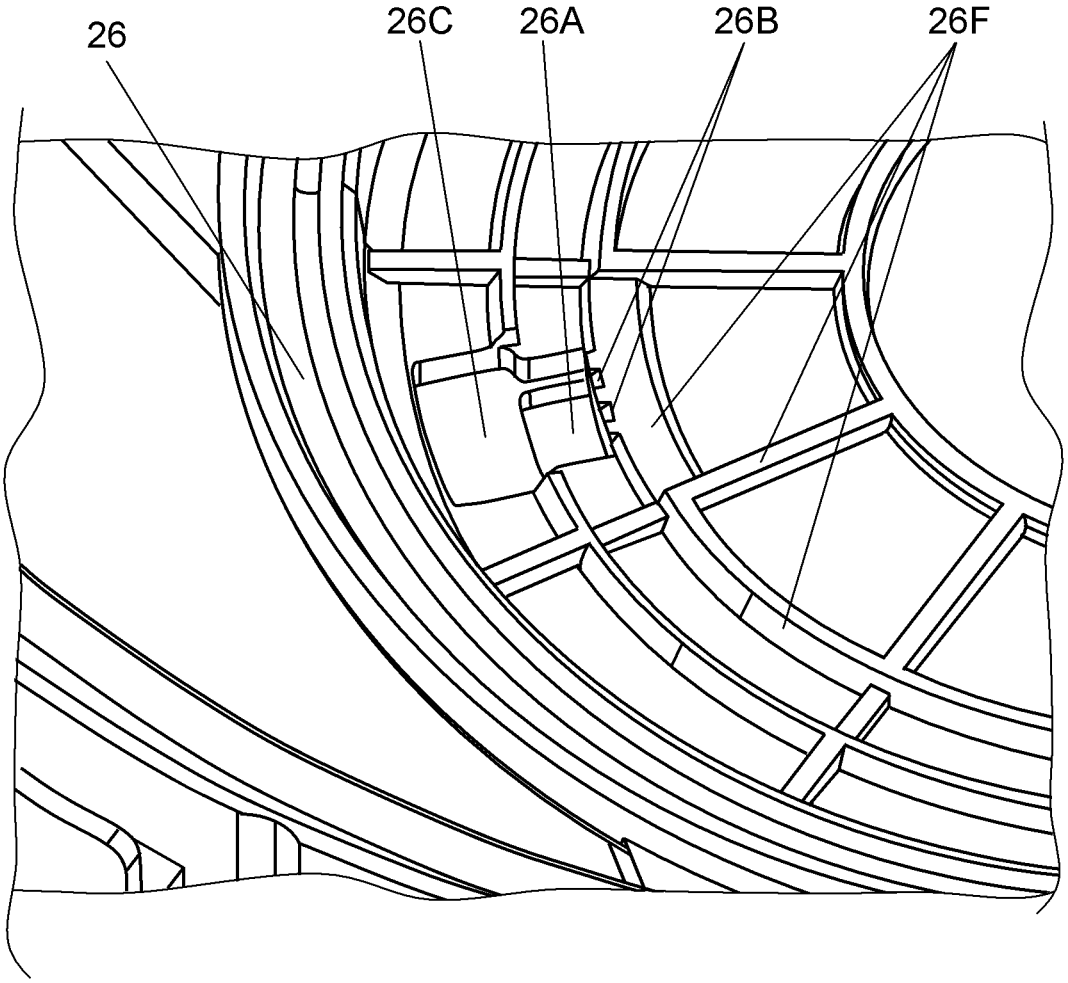
FIG. 6 is an enlarged perspective view of the substantial part of the frame of the loudspeaker.

FIG. 3 is a perspective view of upper plate 21. FIG. 4 is a perspective view of frame 26. FIG. 5 is an enlarged perspective view of the substantial part in a state where frame 26 is coupled with upper plate 21. FIG. 6 is an enlarged perspective view of the substantial part of frame 26.

As shown in FIG. 4, the bottom of frame 26 is provided therein with through hole 26A for joining magnetic circuit 24. Meanwhile, as shown in FIG. 3, insertion part 21A is formed on a part of the outer circumference of main part 21C. Insertion part 21A is inserted into through hole 26A from the lower face of the bottom of the frame. Penetrating part 21D which is the part of insertion part 21A that penetrates frame 26 is bent. Consequently, frame 26 is sandwiched between penetrating part 21D that is bent, and main part 21C.

Due to the above structure, frame 26 is coupled with main part 21C of upper plate 21, a required level of coupling strength between frame 26 and upper plate 21 can be ensured, and upper plate 21 can be thin, thus making loudspeaker 31 lighter. The structure as well saves materials used for loudspeaker 31, contributing to preserving the global environment. Further, frame 26 is coupled with upper plate 21 by bending penetrating part 21D, thereby decreasing assembly worker-hours of loudspeaker 31, which means loudspeaker 31 is low-cost. Furthermore, frame 26 is coupled with larger strength, thereby increasing the quality and reliability of loudspeaker 31.

Hereinafter, a further detailed description is made of frame 26, upper plate 21, and coupling of frame 26 with upper plate 21. Upper plate 21 includes insertion part 21A and main part 21C. Main part 21C is coupled with frame 26. Insertion part 21A is formed by bending a part of the outer circumference of main part 21C. Insertion part 21A is bent orthogonally, completely or nearly, to main part 21C. Main part 21C viewed from above shows angular parts, for instance, and insertion part 21A is provided at one of the angular parts of main part 21C. In other words, it is preferable that a pair of insertion parts 21A are placed so as to face each other. That is, even-numbered pieces of insertion parts 21A are placed on upper plate 21. For instance, four insertion parts 21A are preferably placed as shown in FIG. 3. The number of insertion parts 21A is not limited to four, but it may be two. In this case, the shape of main part 21C viewed from above has only to have angular parts of multiples of the number of insertion parts 21A. For example, the shape of main part 21C is preferably square, rectangle, or octagonal.

Besides, odd-numbered pieces of insertion parts 21A may be placed on upper plate 21. In this case, main part 21C viewed from above is to be polygonal with each side having the same length. Here, insertion part 21A is preferably placed at the center of each side. For main part 21C having odd-numbered pieces of angular parts, insertion parts 21A are preferably placed on every side, where the shape of upper plate 21 is a regular triangle, regular pentagon, regular hexagon, or the like.

Besides, upper plate 21 may be round or elliptical. In any case, it is preferable that insertion parts 21A are placed on upper plate 21 so that each center line drawn from the center of upper plate 21 to each insertion part 21A intersects at the same angle. This allows magnetic circuit 24 shown in FIG. 1 to be coupled with frame 26 accurately.

Insertion part 21A is preferably shaped so as to be easily inserted into through hole 26A, and thus the tip of insertion part 21A is preferably chamfered, either C-chamfered or R-chamfered.

The above-described structure allows insertion part 21A to be easily inserted into through hole 26A. Therefore, as worker-hours for assembling frame 26 with upper plate 21 can be reduced, the productivity of loudspeaker 31 shown in FIG. 1 is increased.

Further, the central part of upper plate 21 preferably undergoes burring machining. Specifically, burring 21B is formed on the inner circumference of the hole formed in the center of main part 21C of upper plate 21. Preferably, burring 21B projects in the direction same as that in which insertion part 21A of upper plate 21 projects. Burring 21B is a circumferential wall vertically projecting from main part 21C. This structure provides a wider magnetic pole of upper plate 21, resulting in a larger area size of the magnetic pole facing center pole 23A. Consequently, the width of the magnetic pole is increased without increasing the thickness of upper plate 21. Burring 21B may project in the direction opposite to that in which insertion part 21A of upper plate 21 projects.

The above-described structure allows magnetic gap 25 to be formed between the inner circumferential surface of burring 21B and the outer side surface of center pole 23A. Therefore, the area size of the part where the magnetic pole part faces center pole 23A can be increased. Consequently, loudspeaker 31 shown in FIG. 1 has favorable power linearity and withstands high input voltages. In addition, as upper plate 21 is made lighter, loudspeaker 31 shown in FIG. 1 can be lighter. Furthermore, resources for producing upper plate 21 are reduced.

As shown in FIG. 4, the central bottom part of frame 26 is provided with hole 26D. Burring 21B is fitted into hole 26D. That is, the external diameter of burring 21B is nearly the same as the internal diameter of hole 26D. As a result, upper plate 21 can be fixed to frame 26 accurately. This structure makes the center of upper plate 21 coincide with the center of frame 26 accurately. Thus, defects caused by positional discrepancy in attachment of upper plate 21 with frame 26 can be reduced. For example, the structure prevents damper 29 and diaphragm 27 from riding on the guide of frame 26, and thus loudspeaker 31 has high quality and high reliability.

Next, a description is made of coupling upper plate 21 with frame 26. Insertion part 21A is inserted into through hole 26A of frame 26. In this state, insertion part 21A penetrates frame 26, and thus penetrating part 21D projects from the top surface of frame 26. In other words, the tip of insertion part 21A has penetrating part 21D formed thereon.

Then, penetrating part 21D is bent using a bending jig such as a mold, a die, or the like. The structure couples frame 26 with upper plate 21. Meanwhile, penetrating part 21D may be bent either inward or outward. Otherwise, penetrating part 21D may be bent inward and outward in combination, namely some of insertion parts 21A may be bent outward and the others may be bent inward. However, when even-numbered pieces of insertion parts 21A are placed on upper plate 21, a pair of insertion parts 21A facing each other are both bent inward or outward, which allows upper plate 21 to be coupled with frame 26 accurately.

Figure 7:
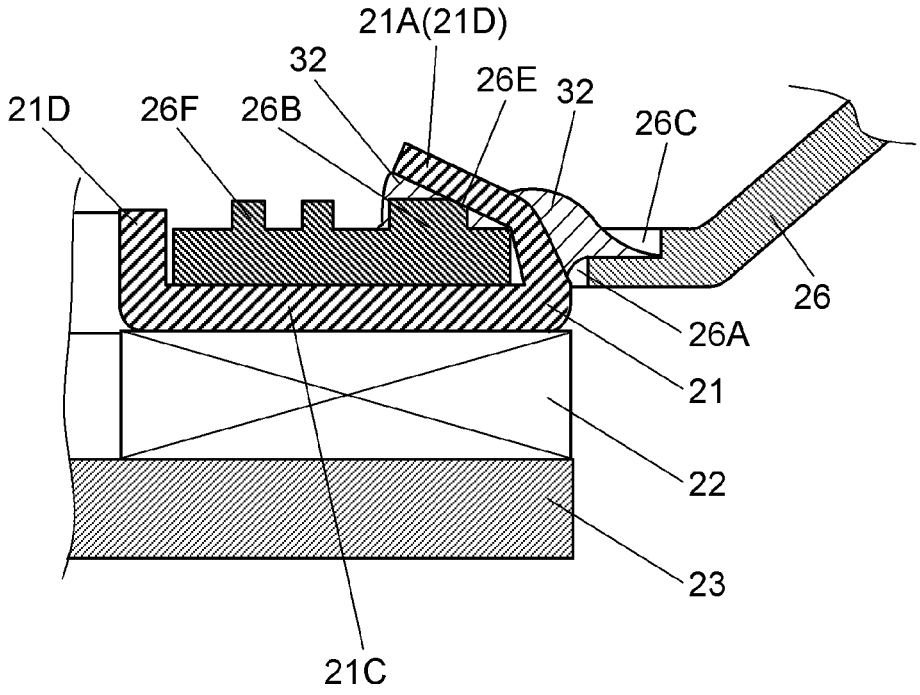
FIG. 7 is an enlarged perspective view of the substantial part of the loudspeaker according to the embodiment of the present invention, in a case where a penetrating part is bent inward.

FIG. 7 is an enlarged sectional view of the substantial part of loudspeaker 31 in a case where penetrating part 21D is bent inward. Penetrating part 21D is bent in the direction toward the inside of frame 26. To bend penetrating part 21D outward, frame 26 needs a space for placing penetrating part 21D that has been bent in the direction toward the outside from through hole 26A. Penetrating part 21D, however, is bent inward, and thus frame 26 does not need a space for placing penetrating part 21D that has been bent in the direction toward the outside from through hole 26A, resulting in a shorter external diameter of frame 26. This reduces the external diameter of loudspeaker 31 shown in FIG. 1. When bending penetrating part 21D inward, it is preferable to bend it toward the center of frame 26.

Figure 8:
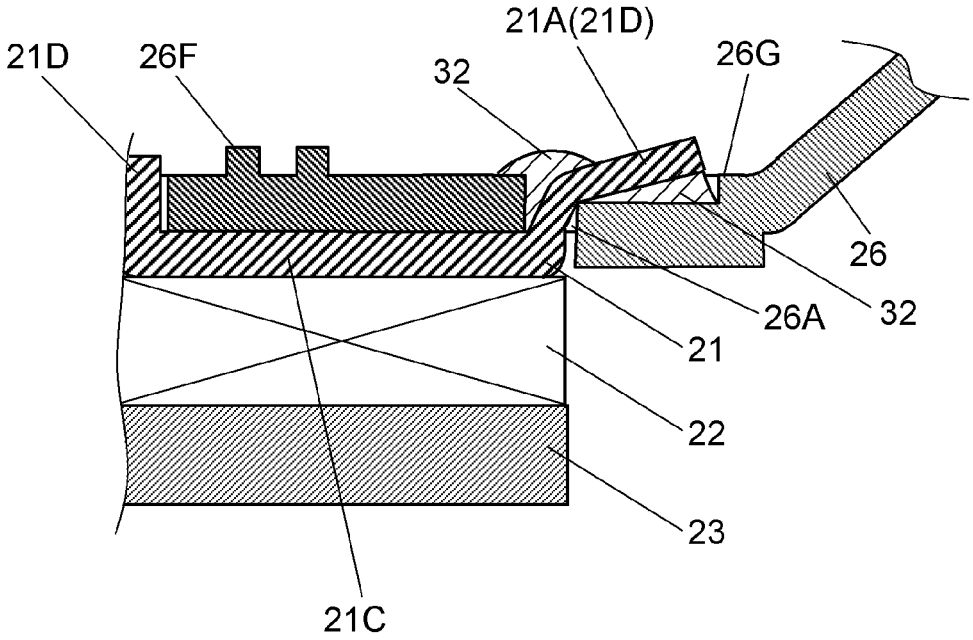
FIG. 8 is an enlarged perspective view of the substantial part of the loudspeaker according to the embodiment of the present invention, in a case where the penetrating part is bent outward.

FIG. 8 is an enlarged sectional view of the substantial part of loudspeaker 31 in a case where penetrating part 21D is bent outward. When bending penetrating part 21D outward, main part 21C does not heightwise overlap with penetrating part 21D that has been bent. Thus, the coupled part of upper plate 21 and frame 26 can be thinner, and therefore the height of loudspeaker 31 shown in FIG. 1 can be lower. To bend penetrating part 21D outward, it is preferable to bend it along the line passing through the center of frame 26 and the center of insertion part 21A.

When bending penetrating part 21D outward, frame 26 may be provided with recess 26G at a place below penetrating part 21D that has been bent. This structure reduces the projecting length of bent penetrating part 21D from the top surface of the frame bottom. This makes the coupled part of upper plate 21 and frame 26 further thinner. Bent penetrating part 21D is provided on the outer circumference of upper plate 21, and thus upper plate 21 is not present at the back side of recess 26G. Hence, the thickness of frame 26 at the back side of recess 26G can be made thicker, thus breakage of frame 26 can be suppressed even if frame 26 undergoes stress due to bending of insertion part 21A.

The plane at the bottom of frame 26, with which upper plate 21 is coupled, is flat. Meanwhile, the top surface of the bottom of frame 26 has reinforcing rib 26F formed thereon as shown in FIG. 6. Therefore, the strength of frame 26 can be increased and the weight of frame 26 can be reduced. Here, reinforcing rib 26F is preferably provided near through hole 26A. The structure increases the strength of frame 26 near through hole 26A. This prevents deformation and breakage of frame 26 due to bending of penetrating part 21D.

In a case where coupling strength between frame 26 and upper plate 21 is weak, a minute gap between frame 26 and upper plate 21 may be generated. In such a case, resonance between frame 26 and upper plate 21 causes frame 26 to contact upper plate 21 in the gap, which may generate unusual sound.

To prevent unusual sound, frame 26 is preferably provided with projection 26B near through hole 26A. Projection 26B, however, is provided under insertion part 21A that has been bent. Projection 26B is preferably provided around through hole 26A, for instance. Further, penetrating part 21D, when bent, preferably touches projection 26B. In this case, projection 26B is press-contacted by penetrating part 21D, which allows upper plate 21 to be fixed to frame 26. Further, when penetrating part 21D is bent, it preferably crushes projection 26B. This structure causes the tip of projection 26B to buckle to form buckling part 26E in projection 26B. Buckling part 26E of projection 26B forms a shape extending along bent penetrating part 21D. Consequently, the area where frame 26 contacts insertion part 21A of upper plate 21 can be enlarged.

Therefore, the structure further increases the coupling strength between frame 26 and upper plate 21, thereby suppressing unusual sound produced while loudspeaker 31 is in operation.

As frame 26 is formed of resin, frame 26 can be configured into a complicated shape. For example, the thickness of frame 26 can be changed as appropriate depending on a position in it. Therefore, frame 26 is easily provided with projection 26B and reinforcing rib 26F.

Further, as shown in FIGS. 5 and 6, frame 26 is preferably provided with space 26C near through hole 26A. More specifically, frame 26 is provided with space 26C at the side opposite to the direction in which penetrating part 21D is bent with respect to through hole 26A. For example, space 26C may be formed by making thinner the area where the bending jig contacts frame 26. In this case, space 26C is a recess provided in frame 26. Alternatively, space 26C may be formed as a through hole. That is, space 26C is preferably formed in an area where the bending jig contacts frame 26.

Such a structure allows space 26C to prevent the bending jig from touching frame 26 when bending penetrating part 21D, and thus penetrating part 21D can be bent to a predetermined angle. The structure further reduces variations in the bending angle of penetrating part 21D, and so that variations in the bond strength between frame 26 and upper plate 21 can be reduced. Further, penetrating part 21D can be bent safely and smoothly, thus the productivity of loudspeaker 31 shown in FIG. 1 is increased. Moreover, frame 26, formed of resin, is provided with space 26C easily.

Further, adhesive agent 32 is preferably applied to near projection 26B and space 26C. Specifically, projection 26B is bonded to bent penetrating part 21D with adhesive agent 32. This structure fixes projection 26B to penetrating part 21D with adhesive agent 32, which further increases the bond strength between frame 26 and upper plate 21, thereby further preventing unusual sound.

Alternatively, adhesive agent 32 may be applied to near space 26C. In this case, the bottom surface and/or side surface of space 26C are preferably bonded to insertion part 21A with adhesive agent 32. For example, the bottom surface and/or side surface of space 26C are bonded to bent penetrating part 21D with adhesive agent 32. Alternatively, space 26C may be filled with adhesive agent 32 to bond insertion part 21A with frame 26. This structure further increases the coupling strength between frame 26 and upper plate 21. As adhesive agent 32 accumulates inside space 26C, adhesive agent 32 can be suppressed flowing into magnetic gap 25. In this case, providing reinforcing rib 26F further reliably suppresses the flow of adhesive agent 32 into magnetic gap 25. Furthermore, applying adhesive agent 32 prevents air inside frame 26 from leaking outside as well as air outside frame 26 from entering the inside of frame 26. Therefore, unusual sound due to leakage and ingress of air are suppressed.

The above-described structure provides loudspeaker 31 with light weight, resource saving, and low cost, as well as high quality and reliability.

Figure 9:
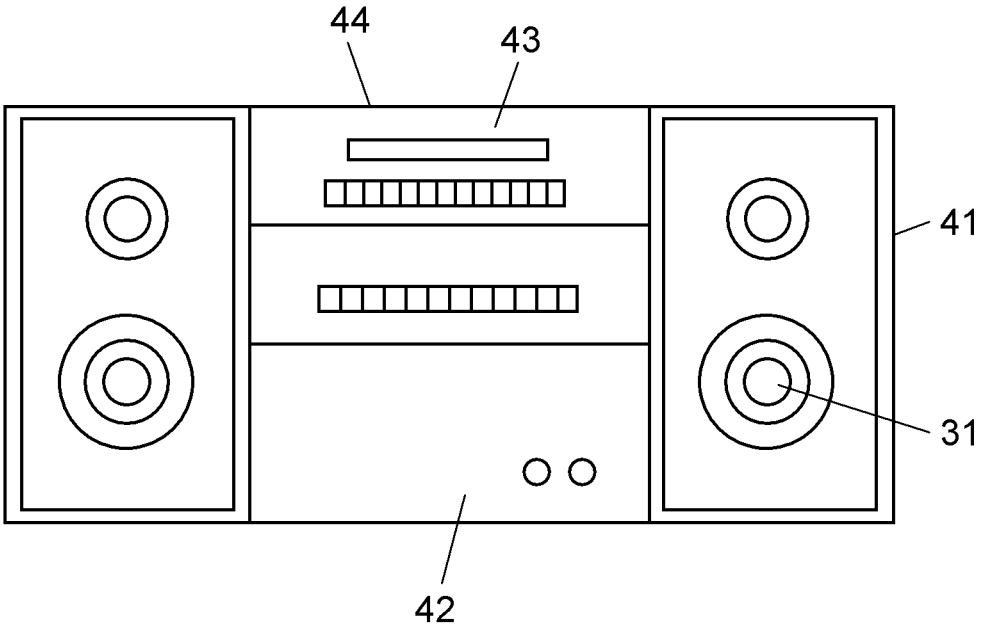
FIG. 9 is an external view of an electronic device including the loudspeaker according to the embodiment of the present invention.
Figure 10:
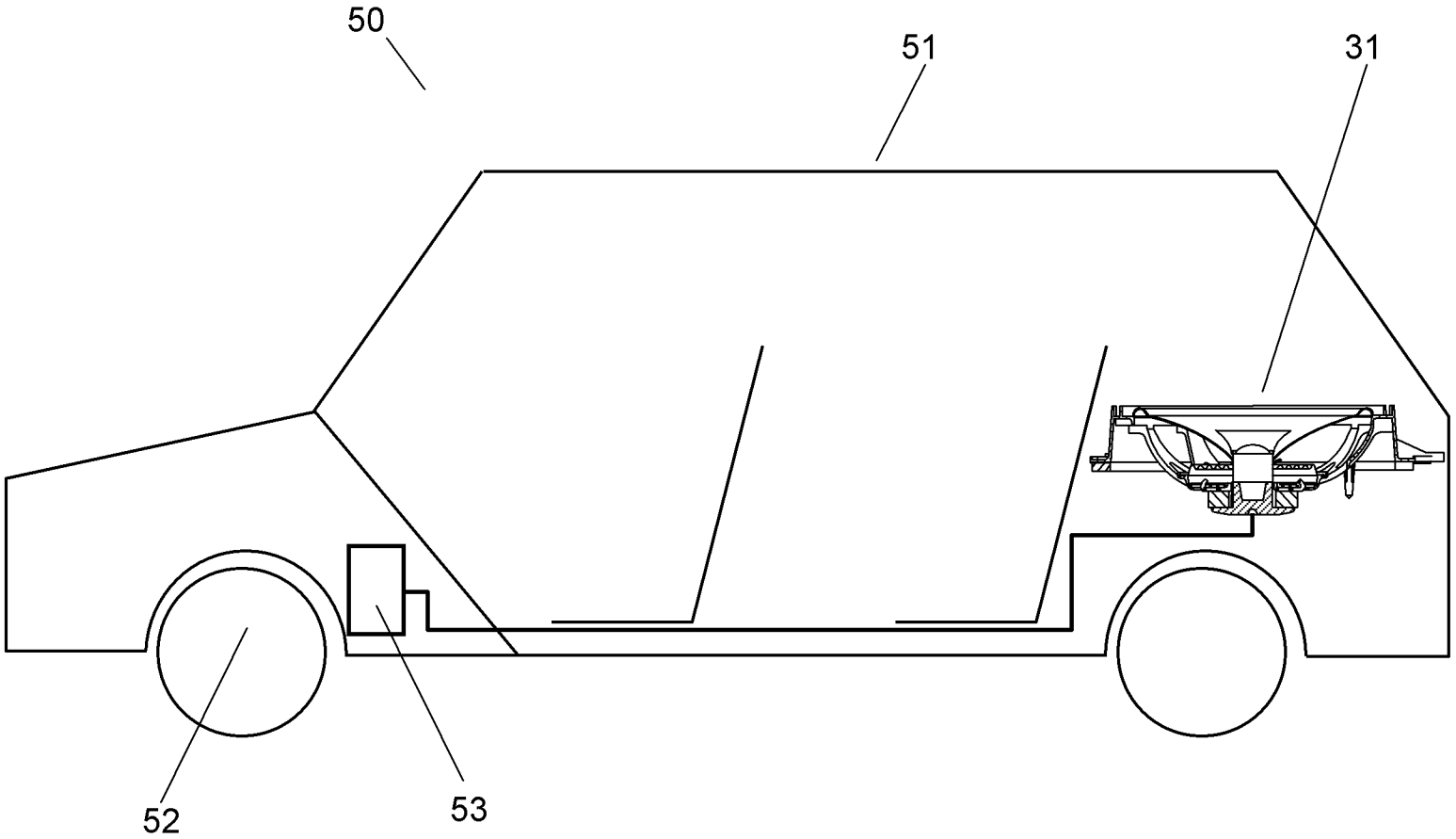
FIG. 10 is a conceptual diagram of a mobile device including the loudspeaker according to the embodiment of the present invention.

Next, a description is made of some examples of an electronic device and a mobile device both including loudspeaker 31 shown in FIG. 1 with reference to FIGS. 9 and 10. FIG. 9 is an external view of an electronic device including loudspeaker 31. The electronic device is mini-audio instrument system 44, for instance. Mini-audio instrument system 44 includes enclosure 41, amplifier 42, and loudspeaker 31. Mini-audio instrument system 44 may further include player 43. Enclosure 41 accommodates loudspeaker 31 and amplifier 42. Enclosure 41 may further accommodate player 43. Amplifier 42 is amplifying means and amplifies electric signals to output them to loudspeaker 31. That is, loudspeaker 31 is electrically connected to amplifier 42, directly or indirectly. Player 43 outputs sources to be input to amplifier 42. Enclosure 41 may be composed of a loudspeaker enclosure for accommodating loudspeaker 31 and an amplifier enclosure for accommodating amplifier 42 and some other components.

The above-described structure makes mini-audio instrument system 44 lighter. Mini-audio instrument system 44 uses less raw materials, which contributes to preserving the global environment. Furthermore, loudspeaker 31 is high in productivity, which lowers the price of mini-audio instrument system 44. Also, as loudspeaker 31 has high quality and reliability, mini-audio instrument system 44 has high quality and reliability.

FIG. 10 is a conceptual diagram of a mobile device incorporating loudspeaker 31. The mobile device is automobile 50, for instance, but not limited to automobile 50. The mobile device may be a bicycle, motorbike, shipping craft, aircraft, or train. Automobile 50 includes main part 51, driving part 52, amplifier 53, and loudspeaker 31. Main part 51 accommodates driving part 52, amplifier 53, and loudspeaker 31. Amplifier 53 supplies amplified signals to loudspeaker 31. That is, loudspeaker 31 is electrically connected to amplifier 53, directly or indirectly. Driving part 52 may include an engine, a motor, and/or tires. That is, driving part 52 generates power, and thus main part 51 moves on power from the driving part.

Loudspeaker 31 is typically incorporated into the rear tray and/or front panel of main part 51. Loudspeaker 31 and amplifier 53 compose part of a car navigation system, where they may be used for part of a car audio system.

Installation location for loudspeaker 31 is not limited to a rear tray or front panel. Loudspeaker 31 may be installed in a door, ceiling, pillar, instrument panel, or floor, for instance.

In loudspeaker 31, upper plate 21 and frame 26 shown in FIG. 1 are strongly coupled together. Thus, loosening in the coupling of upper plate 21 with frame 26 can be suppressed against vibration of automobile 50 during travelling. Resonance between upper plate 21 and frame 26 due to vibration of automobile 50 during travelling can be also suppressed. As a result, unusual sound is suppressed.

The weight reduction of automobile 50 provides favorable fuel efficiency. Automobile 50 uses less raw materials for production, which contributes to preserving the global environment. Loudspeaker 31 is high in productivity, which lowers the price of automobile 50. Loudspeaker 31 has high quality and reliability, so that automobile 50 has high quality and reliability.

Figure 11:
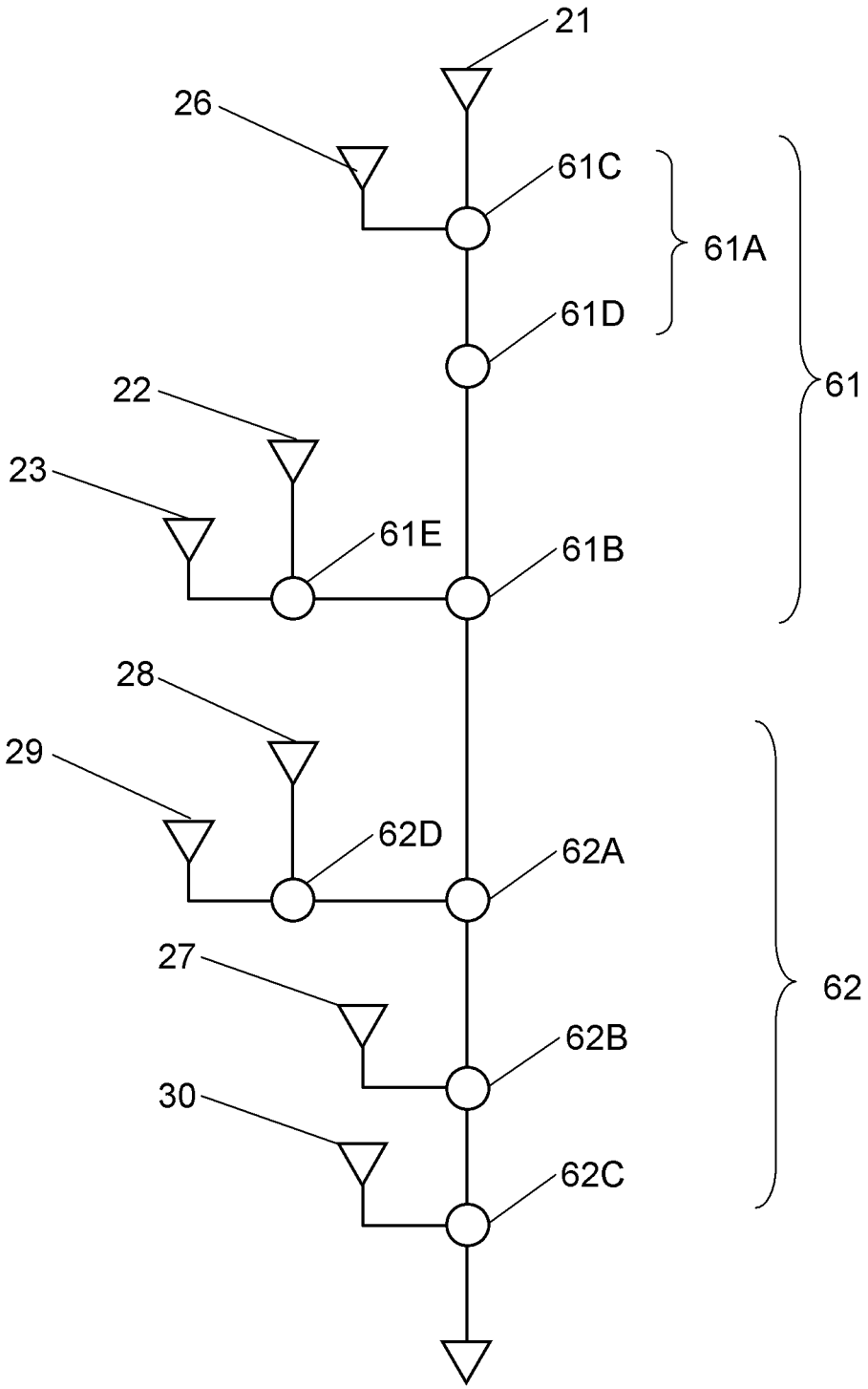
FIG. 11 is a process chart illustrating a method of producing the loudspeaker according to the embodiment of the present invention.

Next, a description is made of a method of producing loudspeaker 31. FIG. 11 is a flowchart for producing loudspeaker 31. The method for producing loudspeaker 31 includes step 61 of coupling magnetic circuit 24 with frame 26, and step 62 of coupling a vibration part with frame 26, where the vibration part includes diaphragm 27 and voice coil 28. The vibration part may further include sub-cone 30. Alternatively, the vibration part may include a dust cap instead of sub-cone 30.

The method for producing loudspeaker 31 may further include a step of producing upper plate 21 and/or a step of producing frame 26.

Step 61 of forming magnetic circuit 24 includes assembling steps 61A and 61B. In step 61, upper plate 21, magnet 22, and lower plate 23 are assembled to form magnetic circuit 24. Center pole 23A is provided at the center of the lower plate as shown in FIG. 1 so as to project from the lower plate. That is, in step 61, magnetic gap 25 is formed between center pole 23A and upper plate 21.

In assembling step 61A, frame 26 is coupled with upper plate 21. In assembling step 61B, magnet 22 and lower plate 23 are coupled with upper plate 21. Assembling step 61B is performed after assembling step 61A.

Assembling step 61A further includes inserting step 61C and bending step 61D. Bending step 61D is performed after inserting step 61C.

In inserting step 61C, insertion part 21A shown in FIG. 1 is inserted into through hole 26A. In this case, upper plate 21 is attached to the lower face side of the bottom of frame 26. In bending step 61D, penetrating part 21D of insertion part 21A projecting toward the front side of frame 26 is bent to a predetermined angle to couple frame 26 with upper plate 21. Insertion part 21A is bent from the front side of frame 26 with a bending jig, which is a mold punch, for instance.

Before assembling step 61B, assembling step 61E may be performed. In assembling step 61E, lower plate 23 is preliminarily coupled with magnet 22. In this case, lower plate 23 is preferably bonded to magnet 22 with an adhesive agent in assembling step 61E. In assembling step 61B, the assembled piece of lower plate 23 and magnet 22 is coupled with the assembled piece of frame 26 and upper plate 21. On this occasion, these two assembled pieces are fixed in a state they are placed at predetermined positions using a gap gauge. For this purpose, the gap gauge supports the inner face of upper plate 21 and the outer face of center pole 23A shown in FIG. 1. Upper plate 21 is preferably bonded to magnet 22 with an adhesive agent.

This structure allows upper plate 21 and center pole 23A shown in FIG. 1 to be accurately placed at predetermined positions. Hence, this structure, which accurately positions center pole 23A, prevents center pole 23A from being decentered with respect to the center of upper plate 21. Consequently, the gap of magnetic gap 25 can be made to a predetermined length accurately. This structure also significantly reduces gap defects generated by contact of voice coil 28 with the places around magnetic gap 25.

In step 61, the assembled piece of lower plate 23 and magnet 22 is coupled with the assembled piece of frame 26 and upper plate 21, but not limited to this case. In step 61, the assembled piece of upper plate 21, lower plate 23, and magnet 22 may be coupled with frame 26, for instance. Alternatively, the assembled piece of upper plate 21, magnet 22, and frame 26 may be coupled with lower plate 23.

Next, step 62 for coupling the vibration part with frame 26 includes inserting step 62A and coupling step 62B. In inserting step 62A, the first end of voice coil 28 is inserted into magnetic gap 25. Further, in inserting step 62A, damper 29 may be coupled with frame 26. In this case, it is preferable to couple frame 26 with damper 29 using a spacer. Before inserting step 62A, it is preferable to provide assembling step 62D in which voice coil 28 is preliminarily coupled with damper 29.

In coupling step 62B, frame 26 is coupled with diaphragm 27. In coupling step 62B, the second end of voice coil 28 may be coupled with the central part of diaphragm 27.

Step 62 may further include coupling step 62C after coupling step 62B. In coupling step 62C, sub-cone 30 is coupled with the central part in the front face of diaphragm 27. In coupling step 62C, a dust cap instead of sub-cone 30 may be coupled with diaphragm 27. The above steps complete producing loudspeaker 31.

The method of producing loudspeaker 31 may further include a step of producing frame 26, which is performed before assembling step 61A. In the step of producing frame 26, resin-molding method such as injection molding is used. The thickness of frame 26, formed by resin molding, can be changed as appropriate depending on a position in it, and thus frame 26 in a complicated shape can be produced easily.

The method of producing loudspeaker 31 may include a step of producing upper plate 21, which is performed before assembling step 61A. The step preferably includes a step of punching upper plate 21 and a step of bending upper plate 21. The step of bending upper plate 21 is performed after the step of punching upper plate 21.

Figure 12:
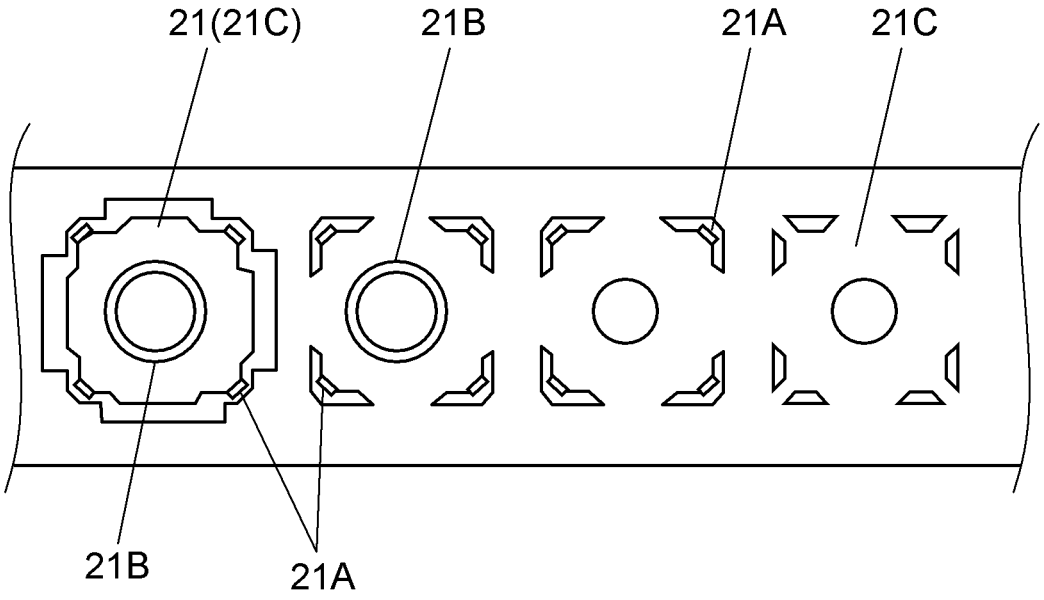
FIG. 12 is a substantial part plan view of a process of producing the upper plate according to the embodiment of the present invention.

FIG. 12 is a plan view of a substantial part of upper plate 21 in its producing process. Upper plate 21 can be formed by processing a thin metal plate, for instance, using a mold. Upper plate 21 can be made of an iron plate, for instance. The thin metal plate is cut to a predetermined width preliminarily. In the punching step for forming the outer shape of upper plate 21, the metal plate in a long, continuous coil is successively trimmed to form upper plate 21. Thus, in the step of producing upper plate 21, upper plates are produced in a state where the upper plate are linked together.

In the step of bending upper plate 21, a part of upper plate 21 is bent to form insertion part 21A shown in FIG. 3. In this step, a magnetic poles may be formed.

The planar shape of upper plate 21 viewed from above shows angular parts, for instance. Insertion parts 21A are preferably formed on four angular parts of upper plate 21. Hence, as shown in FIG. 12, upper plates 21 are efficiently arranged on the long, continuous coiled metal plate. As a result, loss of materials is reduced, thereby increasing the productivity and decreasing the price of upper plate 21.

Next, a description is made of the step of producing frame 26. Frame 26 is formed of resin. Frame 26 can be produced by injection molding, for instance. Hence, projection 26B, space 26C, through hole 26A, hole 26D, and frame 26 are integrally molded easily in the step of producing frame 26, thereby increasing the productivity and decreasing the price of frame 26.

Further, unlike a metal frame, frame 26 resin-molded eliminates the need for a punching step, which reduces loss of raw materials, thereby contributing to resource saving.

Next, a detailed description is made of bending step 61D. In bending step 61D, the bending jig is pressed onto insertion part 21A from the top surface side of frame 26 to apply pressure so as to bend insertion part 21A. Consequently, insertion part 21A is bent as shown in FIG. 1 to couple frame 26 with magnetic circuit 24.

Upper plate 101 and magnetic circuit 104 shown in FIG. 13 are coupled together by punching and deforming projection 101A with a mold. Alternatively, upper plate 101 and magnetic circuit 104 are coupled together by crushing projection 101A with a rotating jig, as in high spin method, for instance. Consequently, in the step of coupling upper plate 101 with magnetic circuit 104, deformation of projection 101A causes machining wastes, which are so small as to undesirably enter magnetic gap 105.

In bending step 61D, insertion parts 21A shown in FIG. 5 are arranged under the punch of the bending jig. In the bending step 61D, upper plate 21 and frame 26 are coupled together by bending insertion parts 21A with the bending jig. This significantly reduces machining wastes generated from insertion parts 21A. As a result, defects such as machining wastes entering the magnetic gap can be suppressed.

Frame 26 is provided with space 26C shown in FIG. 5. In bending step 61D, space 26C shown in FIG. 5 is as well provided under the punch of the bending jig. This prevents the tip of the bending jig from touching frame 26 when the bending jig reaches the bottom dead center of its stroke. As a result, the stroke of the bending jig can be enlonged, thereby allowing insertion part 21A shown in FIG. 1 to be bent to a predetermined angle.

Assembling step 61A may further include a step of applying adhesive agent 32 to the coupled part of frame 26 and upper plate 21. In this case, adhesive agent 32 is preferably used to bond insertion parts 21A to frame 26 or insertion parts 21A to projection 26B, in a state where insertion parts 21A have been bent. Therefore, the step of applying adhesive agent 32 is preferably performed between assembling step 61A and bending step 61D. Consequently, adhesive agent 32 tightly fixes insertion parts 21A to frame 26. The step of applying adhesive agent 32 to the coupled part can be performed before assembling step 61A, or between assembling step 61A and step 62.

Moreover, adhesive agent 32 preferably bonds the frame, space 26C, and insertion parts 21A together. In this case, the step of applying adhesive agent 32 is preferably performed after bending step 61D. This procedure prevents adhesive agent 32 from adhering to the bending jig.

INDUSTRIAL APPLICABILITY

A loudspeaker of the present invention is applicable to a loudspeaker requiring weight reduction and resource saving.

The invention claimed is:

1. A loudspeaker comprising:
a frame provided with a through hole;
an upper plate having a main part coupled with a lower face of the frame;
a magnet under the upper plate;
a lower plate under the magnet;
a center pole disposed at a central part of the lower plate, the center pole forming a magnetic gap between the center pole and the upper plate;
a diaphragm coupled with an outer circumference of the frame; and
a voice coil having a first end coupled with the diaphragm and a second end inserted in the magnetic gap,
wherein the upper plate has:
an insertion part provided at a part of an outer circumference of the main part, inserted into the through hole, and having a penetrating part penetrating the frame and being bent, and
a burring formed at a center of the main part, and
the magnetic gap is formed between the center pole and an inner circumferential surface of the burring.

2. The loudspeaker according to claim 1, wherein the insertion part is bent toward an inside of the frame.

3. The loudspeaker according to claim 1, wherein the insertion part is bent toward an outside of the frame.

4. The loudspeaker according to claim 1,
wherein the frame further includes a projection provided on a surface opposite to a side, joining with the main part of the upper plate, and touching the penetrating part.

5. The loudspeaker according to claim 4,
wherein the frame is made of resin, and
a tip of the projection has a buckling part formed thereon.

6. The loudspeaker according to claim 5, further including an adhesive agent bonding the projection to the penetrating part, or bonding a part of a circumference of the projection to the insertion part.

7. The loudspeaker according to claim 4,
wherein the frame is made of resin, and is provided with a space at a side opposite to a direction, in which the penetrating part is bent, with respect to the through hole.

8. The loudspeaker according to claim 7,
wherein the space is a recess,
the loudspeaker further includes an adhesive agent fed into the recess, and the adhesive agent bonds a periphery of the recess to the penetrating part.

9. An electronic device including:
an enclosure;
an amplifier accommodated in the enclosure; and
the loudspeaker according to claim 1 electrically connected with the amplifier.

10. A mobile device including:
a main part;
a driving part generating power for moving the main part;
an amplifier accommodated in the main part; and
the loudspeaker according to claim 1 electrically connected with the amplifier.

11. A loudspeaker comprising:
a frame provided with a through hole;
an upper plate having a main part coupled with a lower face of the frame;
a magnet under the upper plate;
a lower plate under the magnet;
a center pole disposed at a central part of the lower plate, the center pole forming a magnetic gap between the center pole and the upper plate;
a diaphragm coupled with an outer circumference of the frame; and
a voice coil having a first end coupled with the diaphragm and a second end inserted in the magnetic gap,
wherein the upper plate has an insertion part provided at a part of an outer circumference of the main part, inserted into the through hole, and having a penetrating part penetrating the frame and being bent, and
the frame further includes a projection provided on a surface opposite to a side, joining with the main part of the upper plate, and touching the penetrating part.

12. The loudspeaker according to claim 11,
wherein the frame is made of resin, and
a tip of the projection has a buckling part formed thereon.

13. The loudspeaker according to claim 12, further including an adhesive agent bonding the projection to the penetrating part, or bonding a part of a circumference of the projection to the insertion part.

14. The loudspeaker according to claim 11,
wherein the frame is made of resin, and is provided with a space at a side opposite to a direction in which the penetrating part is bent, with respect to the through hole.

15. The loudspeaker according to claim 14,
wherein the space is a recess,
the loudspeaker further includes an adhesive agent fed into the recess, and the adhesive agent bonds a periphery of the recess to the penetrating part.

16. An electronic device including:
an enclosure;
an amplifier accommodated in the enclosure; and
the loudspeaker according to claim 11 electrically connected with the amplifier.

17. A mobile device including:
a main part;
a driving part generating power for moving the main part;
an amplifier accommodated in the main part; and
the loudspeaker according to claim 11 electrically connected with the amplifier.

* * * * *